US007416078B2

(12) United States Patent
Willis

(10) Patent No.: US 7,416,078 B2
(45) Date of Patent: Aug. 26, 2008

(54) POCKET FLASK APPARATUS

(76) Inventor: Phillip Willis, P.O. Box 13025, South Lake Tahoe, CA (US) 69751

( * ) Notice: Subject to any disclaimer, the term of this patent is extended or adjusted under 35 U.S.C. 154(b) by 555 days.

(21) Appl. No.: 10/821,770

(22) Filed: Apr. 9, 2004

(65) Prior Publication Data

US 2005/0224088 A1 Oct. 13, 2005

(51) Int. Cl.
*B65D 77/00* (2006.01)
*B65D 1/24* (2006.01)
*A24F 3/00* (2006.01)

(52) U.S. Cl. ..... 206/236; 206/217; 206/244; 206/252; 206/86; 220/524; 131/178

(58) Field of Classification Search ..... 206/37, 206/38, 86, 216, 217, 236, 242, 244, 249, 206/252; 220/500, 524, 528, 553, 555; 131/329, 131/178–182

See application file for complete search history.

(56) References Cited

U.S. PATENT DOCUMENTS 498,695 A * 5/1893 Powell ..... 206/229
518,203 A * 4/1894 Zweig ..... 220/524
842,065 A 1/1907 Behrman
975,939 A 11/1910 Edwards
1,471,793 A * 10/1923 Israel ..... 220/521
1,600,758 A 9/1926 Goldstein
2,401,318 A * 6/1946 Robinson et al. ..... 132/308
2,750,066 A 6/1956 Shekter
4,214,658 A * 7/1980 Crow ..... 206/244
4,520,940 A * 6/1985 Boyd et al. ..... 220/627
5,238,140 A * 8/1993 Maze ..... 220/506
5,465,738 A * 11/1995 Rowland ..... 131/329
5,967,310 A * 10/1999 Hill ..... 206/242
5,967,312 A * 10/1999 Jacobs ..... 206/266

FOREIGN PATENT DOCUMENTS

DE 29610839 U1 * 8/1996

* cited by examiner

*Primary Examiner*—J. Gregory Pickett
(74) *Attorney, Agent, or Firm*—Robert M. Sperry, Esq.

(57) ABSTRACT

A pocket flask to be carried within the user's pocket having a hollow housing provided with a curved side wall and a bottom wall connected to the sidewall. A first partition wall divides the housing into a first liquid chamber and a second chamber. A second partition wall divides the second chamber into a tobacco chamber and a pipe housing chamber. A pipe is telescopically receivable within the pipe housing chamber and a first cover, which is pivotally connected to the housing functions to move pipe inwardly of the pipe housing chamber against the urging of a spring. The first cover is movable between a first open position and a second closed position to gain access to the pipe and to the tobacco. A closure wall which has a pouring opening, is connected to the housing for substantially closing the first liquid chamber. A cap removably closes the pouring opening.

12 Claims, 3 Drawing Sheets

POCKET FLASK APPARATUS

BACKGROUND OF THE INVENTION

1. Field of the Invention

The present invention relates generally to pocket flasks. More particularly, the invention concerns a novel pocket flask that includes a first chamber for containing a liquid, a second chamber for containing tobacco and a third chamber for housing a pipe.

2. Discussion of Prior Art

A number of pocket flasks for containing various materials have been suggested in the past. One such pocket flask is disclosed in U.S. Pat. No. 2,750,066 issued to Shekter. The Shekter pocket flask is of a suitable size and shape to be carried in the pocket and contains a chamber for liquid and also one or more additional, separate chambers suitable for carrying a medicine in either dry or liquid form.

The Behrman U.S. Pat. No. 842,066 discloses a tobacco box having a central longitudinal partition by which the box is divided into two compartments, one for storage of a plug of tobacco and the other for holding a plug from which portions may have been severed. A cutter closes one of the compartments and can be used for cutting off a chewing piece from the tobacco plug.

A multi-compartment canteen is disclosed in U.S. Pat. No. 975,939 issued to Edwards. The Edwards Patent concerns a canteen that embodies separate compartments which may contain water, carbid and matches. U.S. Pat. No. 1,600,758 issued to Goldstein describes a pocket container which can be used as a receptacle for tobacco, tobacco user appliances and carbide.

SUMMARY OF THE INVENTION

By way of summary, the present invention concerns a pocket flask comprising of a housing having a curved side wall and a bottom wall connected to the sidewall; a first partition wall dividing the housing into a first liquid chamber and a second chamber; a second partition wall dividing the second chamber into a tobacco chamber and a pipe housing chamber; a pipe telescopically receivable within the pipe housing chamber; a first cover means pivotally connected to the housing for the urging of the pipe inwardly of said pipe housing chamber against the urging of a spring and for closing said open top of said pipe housing chamber, the first cover means being movable between a first open position and a second closed position; and a closure wall connected to the housing for substantially closing the first liquid chamber, the closure wall having a pouring opening formed therein for pouring liquid from the liquid chamber.

With the foregoing in mind, it is an object of the present invention to provide a compact, easy to use flask that can be carried within the user's pocket for sealably containing in separate compartments a liquid beverage, smoking tobacco and a smoking pipe.

Another object of the invention is to provide a pocket flask of the aforementioned character which includes easy to use closure means for sealably closing the various compartments of the pocket flask.

Another object of the invention is to provide a pocket flask as described in the preceding paragraphs which is attractive in appearance and one which can be economically manufactured.

For a further description and understanding of the invention, and for the particular features and advantages thereof, reference should be made to the following description of one embodiment of the invention and the drawings thereof.

DESCRIPTION OF THE INVENTION

Figure 3:
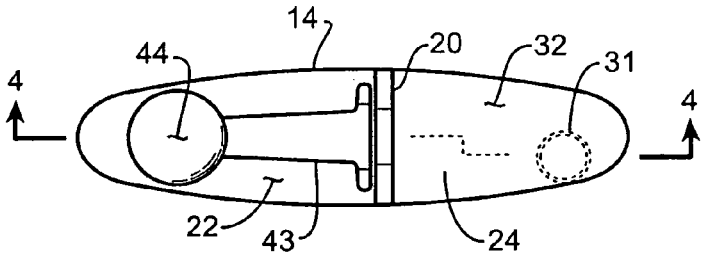
FIG. 3 is a top plan view of the pocket flask shown in FIG. 1.
Figure 4:
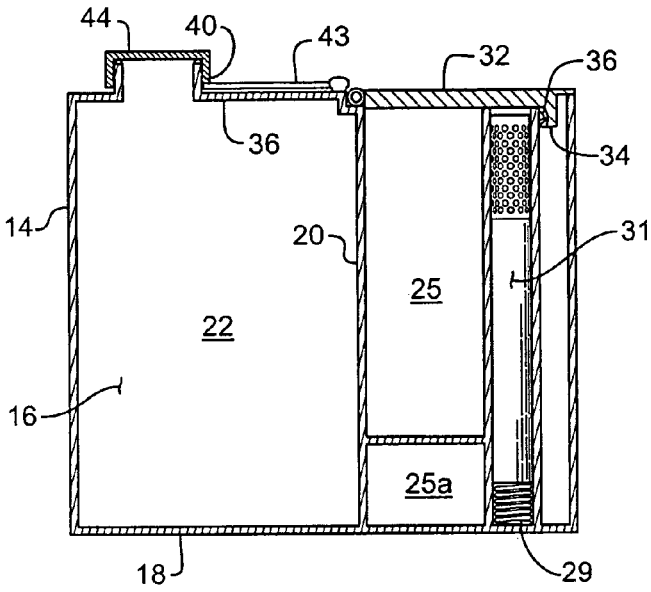
FIG. 4 is a cross-sectional view taken along lines 4-4 of FIG. 3.
Figure 5:
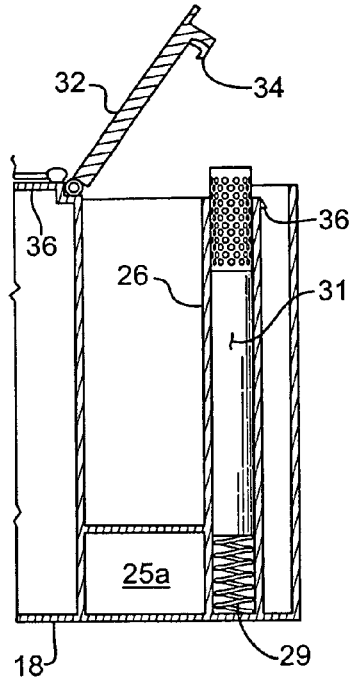
FIG. 5 is a fragmentary, cross-sectional view of the apparatus showing the tobacco compartment cover in an open position.

Referring to the drawings, and particularly to FIGS. 1 through 4, one form of the pocket flask apparatus of the present invention is there shown. This form of the apparatus comprises a housing 14 having a curved side wall 16 and a bottom wall 18 connected to the sidewall. A first partition wall 20 divides the housing into a first liquid chamber 22 for containing a liquid, such as a liquid beverage and a second chamber 24. A second partition wall 26 divides second chamber 24 into a tobacco chamber 25 and a generally cylindrically shaped, pipe housing chamber 28. As indicated in FIGS. 4 and 5, a spacer block **25*a* is positioned within the lower portion of tobacco chamber 25**.

Telescopically receivable within pipe housing chamber 28 is one form of the conventional smoking pipe 31 of the apparatus of the invention. As best seen in FIGS. 4 and 5, biasing means, shown here as a coil spring 29, is provided for biasing pipe 31 outwardly of chamber 28 in the manner shown in FIG. 5. A first cover means, shown as cover 32, is pivotally connected to housing 14 for urging pipe 31 inwardly of pipe housing chamber 28 and for closing the open top of the second chamber in the manner shown in FIG. 6. To maintain cover 32 in the closed position, connector means are provided. These connector means, which is of a character well known to those skilled in the art, here comprises a hook-like member 34 provided on cover 32 and a hook-like protuberance 36 provided on side wall 16 of housing 14. With this construction, when the cover 32 is pivotally moved downwardly against the urging of coil spring 29 from the open position shown in FIG. 5 into the closed position shown in FIG. 6, a hook like member 34 will snap into a locking engagement with protuberance 36 so as to maintain the cover 32 in the closed position. However, a downward force exerted on cover 32 against the urging of spring 29 will permit the cover to be pivotally moved into the open position shown in FIG. 5.

Figure 1:
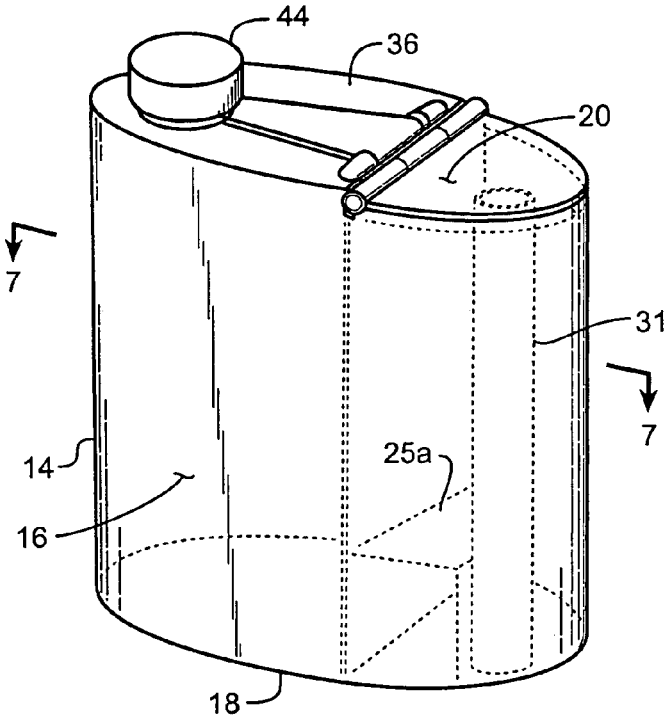
FIG. 1 is a generally perspective view of one form of the pocket flask apparatus of the present invention.
Figure 2:
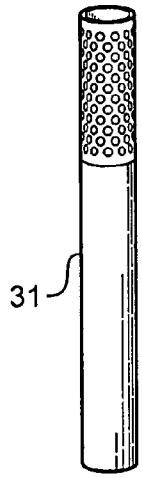
FIG. 2 is a generally perspective view of one form of the pipe component of the pocket flask apparatus of the invention.
Figure 6:
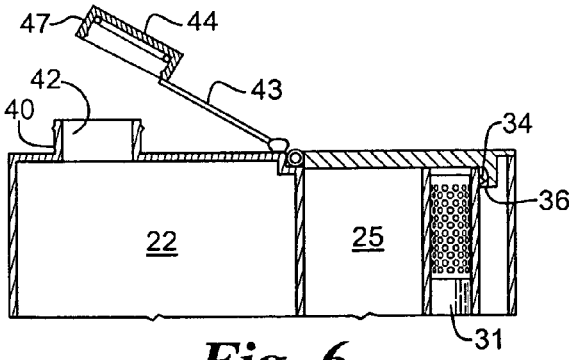
FIG. 6 is a cross-sectional view taken along lines 6-6 of FIG. 1.
Figure 7:
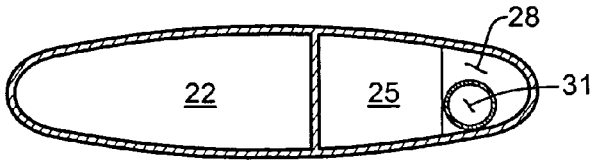
FIG. 7 is a cross-sectional view taken along lines 7-7 of FIG. 1.

As best seen in FIGS. 1 and 3, a closure wall 36 is connected to housing 14 for substantially closing first liquid chamber 22. As indicated in FIG. 6 of the drawings, closure wall 36 includes a generally tubular shaped extension 40 which defines a pouring opening 42 for pouring liquid from first liquid chamber 22.

A second cover means is pivotally connected to closure wall 36 for sealing pouring opening 42 in a manner to block fluid flow from liquid chamber 22. This second cover means here comprises a pivot arm 43 which is pivotally connected to closure wall 36 and is also connected to a closure cap 44, which is receivable over extension 40 and functions to sealably close pouring opening 42. As indicated in FIG. 6 of the drawings, the second cover means is movable between the open position shown in FIG. 6, wherein liquid can be poured through pouring opening 42, and the second position shown in FIG. 4 wherein the closure cap 44 substantially seals the pouring opening. A conventional O-ring 47 (FIG. 6) is disposed within closure cap 44 for sealably engaging tubular wall 40 of the pouring opening when the second cover means is in the closed position.

Figure 8:
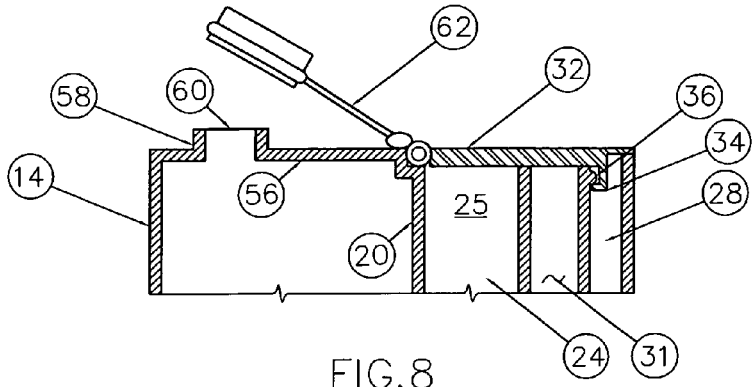
FIG. 8 is a fragmentary, cross-sectional view of an alternate form the apparatus showing a different type of liquid compartment cover in an open position.
Figure 9:
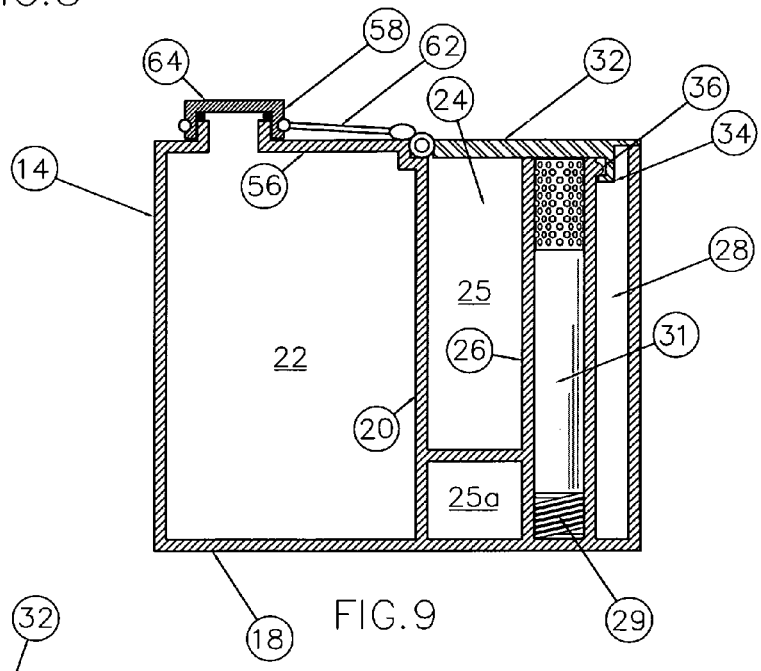
FIG. 9 is a, cross-sectional view of the alternate form the apparatus showing the liquid compartment cover in an closed position.
Figure 10:
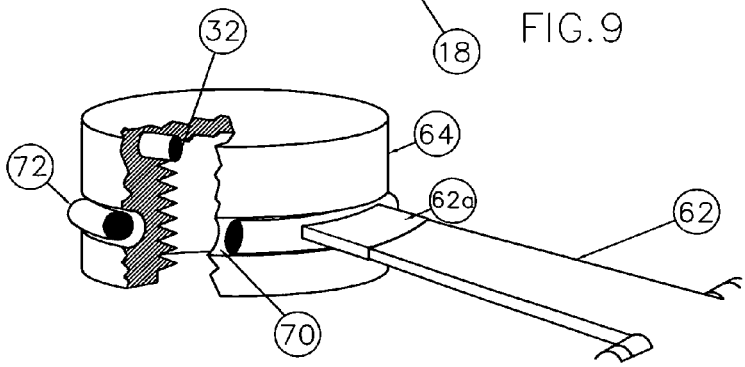
FIG. 10 is an enlarged, generally perspective view, partly broken away to show internal construction, of the alternate form of liquid compartment cover of the invention.

Turning next to FIGS. 8 through 10, an alternate form of the pocket flask apparatus of the invention is there shown. This form of the apparatus is similar in many respects to the form of the apparatus illustrated in FIGS. 1 through 7 and like numerals are used in FIGS. 8 through 10 to identify like components. As best seen in FIGS. 8 and 9, this latest form of the invention also comprises a housing 14 having a curved side wall and a bottom wall 18 connected to the sidewall. A first partition wall 20 divides the housing into a first liquid chamber 22 for containing a liquid, such as a liquid beverage, and a second chamber 24. A second partition wall 26 divides second chamber 24 into a tobacco chamber 25 and a generally cylindrically shaped, pipe housing chamber 28. As before, a spacer block 25*a* is positioned within the lower portion of tobacco chamber 25 (FIG. 9).

Telescopically receivable within pipe housing chamber 28 is one form of the conventional smoking pipe 31 of the apparatus of the invention and biasing means, shown here as a coil spring 29, is provided for biasing pipe 30 outwardly of chamber 28. A first cover means, shown as cover 32, is of identical construction and operation as the cover described in connection with the first embodiment of the invention.

As best seen in FIGS. 8 and 9, a closure wall 56 is connected to housing 14 for substantially closing first liquid chamber 22. Closure wall 56 includes a generally tubular shaped, externally threaded extension 58 which defines a pouring opening 60 for pouring liquid from first liquid chamber 22. A second cover means is pivotally connected to closure wall 56 for sealing pouring opening 60 in a manner to block fluid flow from liquid chamber 22. This second cover means here comprises a pivot arm 62 which is pivotally connected to closure wall 56 and is also connected to an internally threaded closure cap 64, which is threadably connectable to extension 58. When the threaded cap is threadably connected to extension 56 in the manner indicated in FIG. 9, the cap functions to sealably close pouring opening 60. As indicated in FIG. 8 of the drawings, the second cover means is movable between the open position shown in FIG. 8, wherein liquid can be poured through pouring opening 60 and the second position shown in FIG. 10 wherein the closure cap 64 substantially seals the pouring opening. A conventional O-ring 67 (FIG. 10) is disposed within closure cap 64 for sealably engaging tubular wall 58 of the pouring opening when the second cover means of this latest form of the invention is in the closed position. To enable the closure cap to be rotated relative to the pivot arm 62, the cap is provided with the circumferential groove 70 which receives a ring shaped member 72 to which the outboard end 62*a* of the pivot arm is connected. With this construction, cap 64 is free to rotate relative to pivot arm 60 to enable the cap to be threadably interconnected with and disconnected from pouring spout 58.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A pocket flask comprising:

(a) a housing having a curved side wall and a bottom wall connected to said sidewall;

(b) a first partition wall dividing said housing into a first liquid chamber and a second chamber;

(c) a second partition wall dividing said second chamber into a tobacco chamber and a pipe housing chamber having an open top;

(d) a pipe telescopically receivable within said pipe housing chamber;

(e) biasing means carried within said pipe housing chamber for biasing said pipe outwardly of said pipe housing chamber;

(f) a first cover means pivotally connected to said housing for the urging of said pipe inwardly of said pipe housing chamber and for closing said open top of said pipe housing chamber, said first cover means being movable between a first open position and a second closed position;

(g) connector means connected to said housing for releasably maintaining said first cover means in said first closed position;

(h) a closure wall connected to said housing for substantially closing said first liquid chamber, said closure wall having a pouring opening formed therein for pouring liquid from said first liquid chamber; and (i) a second cover means pivotally connected to said closure wall for sealing said pouring opening in said closure wall, said second cover means being movable between an open position wherein liquid can be poured through said pouring opening and a second position substantially sealing said pouring opening.

2. The pocket flask as defined in claim 1 in which said pipe housing chamber is substantially cylindrically shaped in cross-section.

3. The pocket flask as defined in claim 1, further including a spacer block positioned with said tobacco chamber.

4. The pocket flask as defined in claim 1 in which said second cover means comprises a pivot arm connected to said closure wall and a closure cap connected to said pivot arm and sealably receivable over said pouring opening.

5. The pocket flask as defined in claim 4 in which said pouring opening includes an upstanding tubular wall connected to said closure wall and in which said second cover means further includes an O-ring disposed within said closure cap for sealably engaging said tubular wall of said pouring opening.

6. A pocket flask comprising:

(a) a housing having a curved side wall and a bottom wall connected to said sidewall;

(b) a first partition wall dividing said housing into a first liquid chamber and a second chamber;

(c) a second partition wall dividing said second chamber into a tobacco chamber and a generally cylindrically shaped pipe housing chamber having an open top;

(d) a generally cylindrically shaped pipe telescopically receivable within said pipe housing chamber;

(e) biasing means carried within said pipe housing chamber for biasing said pipe outwardly of said pipe housing chamber;

(f) a first cover means pivotally connected to said housing for the urging of said pipe inwardly of said pipe housing chamber and for closing said open top of said pipe housing chamber, said first cover means being movable between a first open position and a second closed position;

(g) connector means connected to said housing for releasably maintaining said first cover means in said first closed position;

(h) a closure wall connected to said housing for substantially closing said first liquid chamber, said closure wall having a pouring opening formed therein for pouring liquid from said first liquid chamber;

(i) a second cover means pivotally connected to said closure wall for sealing said pouring opening in said closure wall, said second cover means being movable between an open position wherein liquid can be poured through said pouring opening and a second position substantially sealing said pouring opening; and (j) a spacer block positioned with said tobacco chamber.

7. The pocket flask as defined in claim 6 in which said second cover means comprises a pivot arm connected to said closure wall and a closure cap connected to said pivot arm and is threadably connected to said pouring opening.

8. The pocket flask as defined in claim 7 in which said pouring opening includes an upstanding, threaded tubular wall connected to said closure wall and in which said second cover means further includes an O-ring disposed within said closure cap for sealably engaging said tubular wall of said pouring opening.

9. A pocket flask comprising:

(a) a housing having a curved side wall and a bottom wall connected to said sidewall;

(b) a first partition wall dividing said housing into a first liquid chamber and a second chamber;

(c) a second partition wall dividing said second chamber into a tobacco chamber and a generally cylindrically shaped pipe housing chamber having an open top;

(d) a generally cylindrically shaped pipe telescopically receivable within said pipe housing chamber;

(e) biasing means carried within said pipe housing chamber for biasing said pipe outwardly of said pipe housing chamber;

(f) a first cover means pivotally connected to said housing for the urging of said pipe inwardly of said pipe housing chamber and for closing said open top of said pipe housing chamber, said first cover means being movable between a first open position and a second closed position;

(g) connector means connected to said housing for releasably maintaining said first cover means in said first closed position;

(h) a closure wall connected to said housing for substantially closing said first liquid chamber, said closure wall having a pouring opening formed therein for pouring liquid from said first liquid chamber;

(i) a second cover means pivotally connected to said closure wall for sealing said pouring opening in said closure wall, said second cover means being movable between an open position wherein liquid can be poured through said pouring opening and a second position substantially sealing said pouring opening, said second cover means comprising a pivot arm connected to said closure wall and a closure cap connected to said pivot arm and sealably receivable over said pouring opening; and (j) a spacer block positioned with said tobacco chamber.

10. The pocket flask as defined in claim 9 in which said pouring opening includes an upstanding tubular wall connected to said closure wall and in which said second cover means further includes an O-ring disposed within said closure cap for sealably engaging said tubular wall of said pouring opening.

11. The pocket flask as defined in claim 10 in which said pouring opening includes an upstanding, externally threaded tubular wall connected to said closure wall and in which said closure cap is rotatably connected to said pivot arm.

12. The pocket flask as defined in claim 11 in which said closure cap includes a circumferential groove and in which said pivot arm includes a ring shaped member received within said groove.

* * * * *